US011613796B2

(12) United States Patent
Ohata

(10) Patent No.: US 11,613,796 B2
(45) Date of Patent: Mar. 28, 2023

(54) CEMENTED CARBIDE AND COMPOSITE CEMENTED CARBIDE ROLL FOR ROLLING

(71) Applicant: HITACHI METALS, LTD., Tokyo (JP)

(72) Inventor: Takumi Ohata, Kitakyusyu (JP)

(73) Assignee: HITACHI METALS, LTD., Tokyo (JP)

( * ) Notice: Subject to any disclaimer, the term of this patent is extended or adjusted under 35 U.S.C. 154(b) by 134 days.

(21) Appl. No.: 16/761,323

(22) PCT Filed: Jan. 31, 2019

(86) PCT No.: PCT/JP2019/003349

§ 371 (c)(1),
(2) Date: May 4, 2020

(87) PCT Pub. No.: WO2019/151389

PCT Pub. Date: Aug. 8, 2019

(65) Prior Publication Data

US 2021/0189528 A1 Jun. 24, 2021

(30) Foreign Application Priority Data

Jan. 31, 2018 (JP) ..... JP2018-016001

(51) Int. Cl.
*C22C 29/08* (2006.01)
*B21B 27/03* (2006.01)
*C22C 1/05* (2006.01)

(52) U.S. Cl.
CPC ..... *C22C 29/08* (2013.01); *B21B 27/03* (2013.01); *C22C 1/05* (2013.01)

(58) Field of Classification Search
CPC ..... C22C 29/08; C22C 1/05; C22C 1/051; C22C 38/02; C22C 38/22; C22C 38/40;
(Continued)

(56) References Cited

U.S. PATENT DOCUMENTS 6,258,147 B1 * 7/2001 Jansson ..... C22C 29/08 419/18
2019/0194783 A1 6/2019 Ohata et al.

FOREIGN PATENT DOCUMENTS

JP 56-013458 A 2/1981
JP 05-171339 A 7/1993
(Continued)

OTHER PUBLICATIONS

"Alternative Binder Phases for WC cemented Carbides", Liu Chunxin, Master Thesis in Engineering Materials Science KTH, 2014 (Liu) (Year: 2014).*

(Continued)

*Primary Examiner* — Humera N. Sheikh
*Assistant Examiner* — Kevin Ct Li
(74) *Attorney, Agent, or Firm* — Sughrue Mion, PLLC

(57) ABSTRACT

A cemented carbide comprising 55-90 parts by mass of WC particles and 10-45 parts by mass of a Fe-based binder phase; the binder phase having a composition comprising 0.5-10% by mass of Ni, 0.2-2% by mass of C, 0.5-5% by mass of Cr, 0.2-2.0% by mass of Si, and 0.1-5% by mass of W, the balance being Fe and inevitable impurities, and containing 0.05-2.0% by area of Fe—Si—O-based particles.

13 Claims, 4 Drawing Sheets

(58) Field of Classification Search
CPC ..... C22C 38/44; C22C 38/001; C22C 38/34; B21B 27/03; B21B 27/02; B21B 39/165; C21D 221/002; C21D 221/008; B22F 2005/002; B22F 3/15; B23B 27/14
See application file for complete search history.

(56) References Cited

FOREIGN PATENT DOCUMENTS

| | | | | |
|---|---|---|---|---|
| JP | 2000-219931 | A | | 8/2000 |
| JP | 2001-081526 | A | | 3/2001 |
| JP | 2004-148321 | A | | 5/2004 |
| JP | 2004148321 | A | * | 5/2004 |
| JP | 2004243380 | A | * | 9/2004 |
| WO | 2018/025848 | A1 | | 2/2018 |

OTHER PUBLICATIONS

"Carbide phases formed in WC-M (M = Fe/Ni/Cr) systems", Fernandes et al., Ceramics International 35, 2009, pp. 369-372 (Fernandes) (Year: 2009).*
"Microstructure and mechanical properties of WC Ni—Si based cemented carbides developed by powder metallurgy", Correa et al, Int. Journal of Refractory Metals and Hard Materials 28, 2010, pp. 572-575 (Correa) (Year: 2010).*
International Search Report for PCT/JP2019/003349 dated Mar. 12, 2019 [PCT/ISA/210].

* cited by examiner

CEMENTED CARBIDE AND COMPOSITE CEMENTED CARBIDE ROLL FOR ROLLING

CROSS REFERENCE TO RELATED APPLICATIONS

This application is a National Stage of International Application No. PCT/JP2019/003349 filed Jan. 31, 2019, claiming priority based on Japanese Patent Application No. 2018-016001 filed Jan. 31, 2018.

FIELD OF THE INVENTION

The present invention relates to a cemented carbide comprising an binder phase of an iron-based alloy having excellent wear resistance and compressive yield strength as well as excellent sticking resistance, and a composite roll of such cemented carbide for rolling.

BACKGROUND OF THE INVENTION

Because cemented carbides comprising WC particles sintered with Co—Ni—Cr-based binder phases have high hardness and mechanical strength and excellent wear resistance, as well as high sticking resistance, they are widely used for cutting tools, rolling rolls, etc.

For example, JP H5-171339 A discloses a WC—Co—Ni—Cr cemented carbide, in which WC+Cr is 95% or less by weight, Co+Ni is less than 10% by weight, and Cr/Co+Ni+Cr is 2-40%. JP H5-171339 A describes that because cemented carbide having such a composition has higher wear resistance and toughness than those of conventional composition alloys, it can be used for hot-rolling rolls and guide rollers, largely contributing to the reduction of a roll cost, such as increase in the rolling amount per caliber, the reduction of regrinding depth, the reduction of breakage, etc. However, the rolling roll of cemented carbide composed of WC particles and a Co—Ni—Cr binder phase fails to conduct sufficient cold rolling of steel strips. Intensive research has revealed that such insufficient cold rolling is caused by insufficient reduction of a steel strip, because the cemented carbide having a Co—Ni—Cr binder phase has as low compressive yield strength as 300-500 MPa, suffering yield on the roll surface during the cold rolling of steel strips. Further, the cemented carbide described in JP H5-171339 A suffers sticking when used for hot-rolling rolls.

JP 2000-219931 A discloses a cemented carbide comprising 50-90% by mass of submicron WC and a binder phase having hardenability, the binder phase comprising 10-60% by mass of Co, less than 10% by mass of Ni, 0.2-0.8% by mass of C, and Cr and W and optionally Mo and/or V, in addition to Fe, the molar ratios $X_C$, $X_{Cr}$, $X_W$, $X_{Mo}$ and $X_V$ of C, Cr, W, Mo and V in the binder phase meeting the condition of $2X_C<X_W+X_{Cr}+X_{Mo}+X_V<2.5X_C$, and the Cr content (% by mass) meeting 0.03<Cr/[100−WC (% by mass)]<0.05. JP 2000-219931 A describes that this cemented carbide has high wear resistance by the binder phase having hardenability. However, it has been found that because this cemented carbide contains 10-60% by mass of Co in the binder phase, it has low hardenability, resulting in insufficient compressive yield strength. It has further been found that because WC particles are as fine as submicron, this cemented carbide has such poor toughness and cracking resistance that it cannot be used for an outer layer of a rolling roll.

JP 2001-81526 A discloses an iron-based cemented carbide comprising 50-97% by weight of WC and an Fe-based binder phase, the binder phase comprising 0.35-3.0% by weight of C, 3.0-30.0% by weight of Mn, and 3.0-25.0% by weight of Cr. JP 2001-81526 A describes that utilizing the martensitic transformation of Fe, an iron-based cemented carbide having improved hardness and strength, as well as excellent wear resistance and corrosion resistance, is obtained. In this iron-based cemented carbide, part or all of Mn in the Fe-based binder phase may be substituted by Ni, and Nos. 14 and 16 in Example contain 4% by mass of Ni. However, because the Ni-containing binder phases in Nos. 14 and 16 contain 8% and 10%, respectively, by mass of Mn contributing to the stabilization of austenite, too much retained austenite in the resultant iron-based cemented carbides, which do not have sufficient compressive yield strength.

JP 2004-148321 A discloses a hot-rolling composite roll comprising an outer layer obtained by sintering 10-50% by mass of a carbide and/or nitride powder of Ti, Zr, Hf, V, Nb, Ta, Cr, Mo or W and iron-based powder around a steel shaft, the iron-based powder comprising one or more of 0.5-1.5% by mass of C, 0.1-2.0% by mass of Si, 0.1-2.0% by mass of Mn, 0.1-2% by mass of Ni, 0.5-10% by mass of Cr, and 0.1-2% by mass of Mo, the balance being Fe and inevitable impurities, and having a diameter of 250-620 mm and Young's modulus of 240 GPa or more, whereby the hot-rolling composite roll has excellent wear resistance and strength. JP 2004-148321 A describes that this hot-rolling composite roll can conduct rolling at a high reduction, with high quality of rolled products. However, the iron-based powder generally described in the specification of JP 2004-148321 A contains Ni in an as small amount as 0.1-2% by mass, the binder phase of the outer layer does not have sufficient hardenability. Also, because the amount of carbide and/or nitride powder of Ti, Zr, Hf, V, Nb, Ta, Cr, Mo or W is 10-50% by mass, half or less of the total, and because the iron-based powder is a main phase, this outer layer has insufficient wear resistance, exhibiting poor performance in rolling.

In view of the above circumstances, cemented carbide having sufficient compressive yield strength, thereby less suffering dents on the roll surface due to yield even when used in the cold rolling of metal strips, and no sticking when used for hot rolling rolls, is desired.

OBJECTS OF THE INVENTION

Accordingly, an object of the present invention is to provide a cemented carbide having high wear resistance and mechanical strength and sufficient compressive yield strength, as well as excellent sticking resistance.

Another object of the present invention is to provide a rolling composite roll of cemented carbide suffering no dents on the roll surface when used in the cold rolling of metal strips, and no sticking when used as a hot-rolling roll.

SUMMARY OF THE INVENTION

As a result of intensive research in view of the above objects, the inventors have found that in a cemented carbide comprising WC particles and an Fe-based binder phase, the above problems can be solved by providing the binder phase with a particular composition and a structure containing a particular area ratio of Fe—Si—O-based particles. The present invention has been completed based on such finding.

Thus, the cemented carbide of the present invention comprises 55-90 parts by mass of WC particles and 10-45 parts by mass of an Fe-based binder phase;

the binder phase having a composition comprising 0.5-10% by mass of Ni, 0.2-2% by mass of C, 0.5-5% by mass of Cr, 0.2-2.0% by mass of Si, and 0.1-5% by mass of W, the balance being Fe and inevitable impurities, and containing 0.05-2.0% by area of Fe—Si—O-based particles.

The cemented carbide preferably does not contain Fe—Si—O-based particles having equivalent circle diameters of 3 μm or more.

Among the Fe—Si—O-based particles, the ratio of particles having equivalent circle diameters of 0.1-3 μm is preferably 0.05-2.0% by area in total.

The cemented carbide preferably contains substantially no composite carbides having equivalent circle diameters of 5 μm or more.

The WC particles preferably have a median diameter D50 of 0.5-10 μm.

The binder phase preferably further contains 0-5% by mass of Co, and 0-1% by mass of Mn.

The total amount of bainite phases and/or martensite phases in the binder phase is preferably 50% or more in total by area.

The cemented carbide preferably has compressive yield strength of 1200 MPa or more.

The composite cemented carbide roll for rolling according to the present invention comprises an outer layer made of the above cemented carbide, which is metallurgically bonded to an outer peripheral surface of a steel sleeve or shaft.

Effects of the Invention

Because the generation of fine dents due to compressive yielding on the roll surface is suppressed in the composite cemented carbide roll comprising an outer layer made of the cemented carbide of the present invention even when used for the cold rolling of metal (steel) strips, and sticking is unlikely to occur when used for hot rolling, the high-quality cold or hot rolling of steel strips can be continuously conducted, with a long life span.

BRIEF DESCRIPTION OF THE DRAWINGS

FIG. 1(*b*) is a photograph of a backscattered electron image of SEM showing a cross section structure of the cemented carbide of Sample 1 (within the present invention) in the same field as in FIG. 1(*a*).

FIG. 2(*b*) is a photograph of a backscattered electron image of SEM showing a cross section structure of the cemented carbide of Sample 2 (Comparative Example) in the same field as in FIG. 2(*a*).

DESCRIPTION OF THE PREFERRED EMBODIMENTS

Figure 1A:
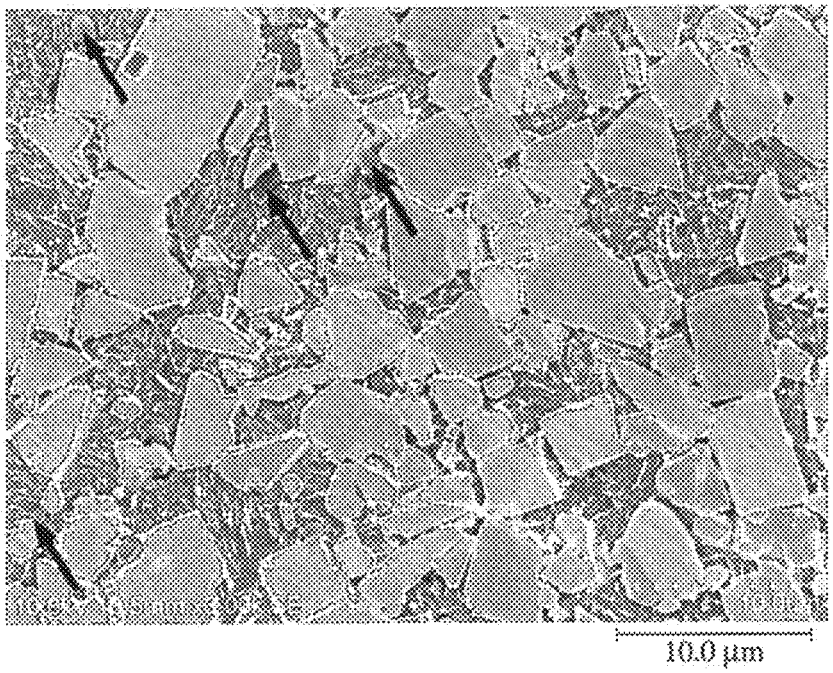
FIG. 1(*a*) is a photograph of a secondary electron image of SEM showing a cross section structure of the cemented carbide of Sample 1 (within the present invention).

The embodiments of the present invention will be explained in detail below. Explanations of one embodiment are applicable to other embodiments unless otherwise mentioned. The following explanations are not restrictive, but various modifications may be made within the scope of the present invention.

[1] Cemented Carbide (A) Composition

The cemented carbide of the present invention comprises 55-90 parts by mass of WC particles and 10-45 parts by mass of an Fe-based binder phase.

(1) WC Particles

The amount of WC particles in the cemented carbide of the present invention is 55-90 parts by mass. When WC particles are less than 55 parts by mass, the amount of hard WC particles is relatively small, providing the cemented carbide with too low Young's modulus. On the other hand, when WC particles exceed 90 parts by mass, the amount of the binder phase is relatively small, failing to provide the cemented carbide with enough strength. The lower limit of the amount of WC particles is preferably 60 parts by mass, and more preferably 65 parts by mass. Also, the upper limit of the amount of WC particles is preferably 85 parts by mass.

The WC particles preferably have a median diameter D50 (corresponding to a particle size at a cumulative volume of 50%) of 0.5-10 μm. When the average particle size is less than 0.5 μm, there are increased boundaries between the WC particles and the binder phase, making it likely to generate composite carbides described below, thereby reducing the strength of the cemented carbide. On the other hand, when the average particle size exceeds 10 μm, the strength of the cemented carbide is lowered. The lower limit of the median diameter D50 of WC particles is preferably 1 μm, more preferably 2 μm, and most preferably 3 μm. Also, the upper limit of the median diameter D50 of WC particles is preferably 9 μm, more preferably 8 μm, and most preferably 7 μm.

Because WC particles densely exist in a connected manner in the cemented carbide, it is difficult to determine the particle sizes of WC particles on the photomicrograph. Because the cemented carbide of the present invention is produced by sintering a green body at a temperature between (liquid phase generation-starting temperature) and (liquid phase generation-starting temperature+100° C.) in vacuum as described below, there is substantially no particle size difference between WC powder in the green body and WC particles in the cemented carbide. Accordingly, the particle sizes of WC particles dispersed in the cemented carbide are expressed by the particle sizes of WC powder in the green body.

WC particles preferably have relatively uniform particle sizes. Accordingly, in a cumulative particle size distribution curve determined by a laser diffraction and scattering method, the WC particles have a preferable particle size distribution defined below. The lower limit of D10 (particle size at a cumulative volume of 10%) is preferably 0.3 μm, and more preferably 1 μm, and the upper limit of D10 is preferably 3 μm. Also, the lower limit of D90 (particle size at a cumulative volume of 90%) is preferably 3 μm, and more preferably 6 μm, and the upper limit of D90 is preferably 12 μm, and more preferably 8 μm. The median diameter D50 is as described above.

(2) Binder Phase

In the cemented carbide of the present invention, the binder phase has a composition comprising 0.5-10% by mass of Ni, 0.2-2% by mass of C, 0.5-5% by mass of Cr, 0.2-2.0% by mass of Si, and 0.1-5% by mass of W, the balance being Fe and inevitable impurities.

(i) Indispensable Elements (a) Ni: 0.5-10% by Mass

Ni is an element necessary for securing the hardenability of the binder phase. When Ni is less than 0.5% by mass, the binder phase has insufficient hardenability, likely lowering the material strength. On the other hand, when Ni exceeds 10% by mass, the binder phase is turned to have an austenite phase, failing to provide the cemented carbide with sufficient compressive yield strength. The lower limit of the Ni content is preferably 2.0% by mass, more preferably 2.5% by mass, further preferably 3% by mass, and most preferably 4% by mass. Also, the upper limit of the Ni content is preferably 8% by mass, and more preferably 7% by mass.

(b) C: 0.2-2% by Mass

C is an element necessary for securing the hardenability of the binder phase and suppressing the generation of coarse composite carbides. When C is less than 0.2% by mass, the binder phase has insufficient hardenability, and large amounts of composite carbides are generated, resulting in low material strength. On the other hand, when C exceeds 2% by mass, coarse composite carbides are generated, providing the cemented carbide with low strength. The lower limit of the C content is preferably 0.3% by mass, and more preferably 0.5% by mass, and the upper limit of the C content is preferably 1.5% by mass, more preferably 1.2% by mass, and most preferably 1.0% by mass.

(c) Cr: 0.5-5% by Mass

Cr is an element necessary for securing the hardenability of the binder phase. When Cr is less than 0.5% by mass, the binder phase has too low hardenability, failing to obtain sufficient compressive yield strength. On the other hand, when Cr exceeds 5% by mass, coarse composite carbides are generated, providing the cemented carbide with low strength. Cr is preferably 4% or less by mass, and more preferably 3% or less by mass.

(d) Si: 0.2-2.0% by Mass

Si is an element necessary for strengthening the binder phase. Less than 0.2% by mass of Si insufficiently strengthens the binder phase. On the other hand, when Si, a graphitization element, is more than 2.0% by mass, graphite is likely crystallized, providing the cemented carbide with low strength. The lower limit of the Si content is preferably 0.3% by mass, and more preferably 0.5% by mass. Also, the upper limit of the Si content is preferably 1.9% by mass.

(e) W: 0.1-5% by Mass

The W content in the binder phase is 0.1-5% by mass. When the W content in the binder phase exceeds 5% by mass, coarse composite carbides are generated, providing the cemented carbide with low strength. The lower limit of the W content is preferably 0.8% by mass, and more preferably 1.2% by mass. Also, the upper limit of the W content is preferably 4% by mass.

(ii) Optional Elements (a) Co: 0-5% by Mass

Co, which has a function of improving sinterability, is not indispensable in the cemented carbide of the present invention. Namely, the Co content is preferably substantially 0% by mass. However, 5% or less by mass of Co does not affect the structure and strength of the cemented carbide of the present invention. The upper limit of the Co content is more preferably 2% by mass, and most preferably 1% by mass.

(b) Mn: 0-1% by Mass

Mn, which has a function of improving hardenability, is not indispensable in the cemented carbide of the present invention. Namely, the Mn content is preferably substantially 0% by mass. However, 1% or less by mass of Mn does not affect the structure and strength of the cemented carbide of the present invention. The upper limit of the Mn content is more preferably 0.5% by mass, and most preferably 0.3% by mass.

(iii) Inevitable Impurities

The inevitable impurities include Mo, V, Nb, Ti, Al, Cu, N, O, etc. Among them, at least one selected from the group consisting of Mo, V and Nb is preferably 2% or less by mass in total. At least one selected from the group consisting of Mo, V and Nb is more preferably 1% or less by mass, and most preferably 0.5% or less by mass, in total. Also, at least one selected from the group consisting of Ti, Al, Cu, N and O is preferably 0.5% or less by mass alone and 1% or less by mass in total. Particularly, each of N and O is preferably less than 1000 ppm. The inevitable impurities within the above ranges do not substantially affect the structure and strength of the cemented carbide of the present invention.

(B) Structure

The cemented carbide of the present invention has a structure comprising WC particles, a binder phase, and Fe—Si—O-based particles.

(1) Fe—Si—O-Based Particles

Figure 1B:
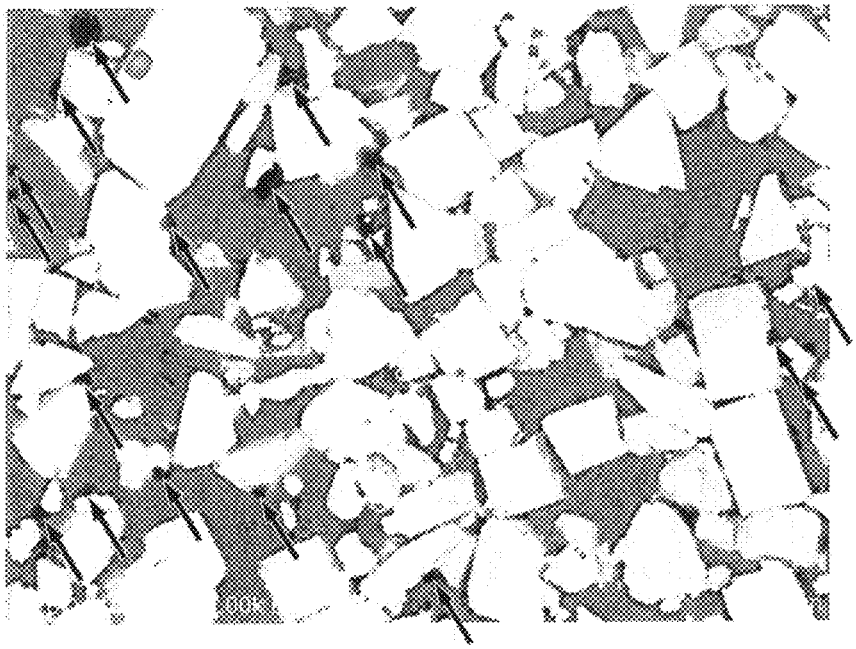

The cemented carbide of the present invention has a structure containing 0.05-2.0% by area of Fe—Si—O-based particles. As shown in FIGS. 1(*a*) and 1(*b*), the Fe—Si—O-based particles are black portions (shown by the arrows) particularly in the backscattered electron image [FIG. 1(*b*)], when observed by SEM on a polished cross section of the cemented carbide. Incidentally, in FIG. 1(*b*), white portions are WC particles, and gray portions are binder phases. the EDX analysis (acceleration voltage: 5 kV, and beam diameter: 1 μm) of the SEM image has confirmed that the Fe—Si—O-based particles comprise 10-30% by mass of Si, 10-40% by mass of 0, 0.3-5% by mass of Ni, 0-3% by mass of C, 0.3-3% by mass of Cr, and 1-10% by mass of W, the balance being Fe and inevitable impurities composition. It is considered that the Fe—Si—O-based particles improve the sticking resistance of the cemented carbide. When the Fe—Si—O-based particles are less than 0.05% by area in total, they do not exhibit a sufficient effect of improving the sticking resistance. More than 2.0% by area of Fe—Si—O-based particles disadvantageously lower the material strength. The lower limit of the total amount of Fe—Si—O-based particles is preferably 0.1% by area, and more preferably 0.2% by area, and the upper limit of the total amount of Fe—Si—O-based particles is preferably 1.8% by area, more preferably 1.6% by area, further preferably 1.4% by area, and most preferably 1.2% by area.

The Fe—Si—O-based particles preferably have equivalent circle diameters of 3 μm or less. When the equivalent circle diameters of the Fe—Si—O-based particles are more than 3 μm, the particles appear as a pattern on a polished surface of the cemented carbide. Accordingly, when such cemented carbide is used for tools such as rolling rolls, etc., the pattern is transferred to a rolled strip, deteriorating the quality of the rolled strips. The lower limit is not particularly restricted, but it is difficult to observe particles having equivalent circle diameters of 0.1 μm or less with high accuracy, and they do not have appreciable influence on the sticking resistance. Accordingly, the Fe—Si—O-based particles having equivalent circle diameters of 0.1-3 μm in the structure of the cemented carbide of the present invention is preferably 0.05-2.0% by area in total. Herein, the equivalent circle diameter of an Fe—Si—O-based particle is a diameter of a circle having the same area as that of the Fe—Si—O-based particle in a photomicrograph (magnification of 1000) of a polished cross section of the cemented carbide.

(2) Composite Carbides

The cemented carbide of the present invention preferably has a structure containing substantially no composite carbides having equivalent circle diameters of 5 μm or more. The composite carbides are those composed of W and metal elements, for example, $(W, Fe, Cr)_{23}C_6$, $(W, Fe, Cr)_3C$, $(W, Fe, Cr)_2C$, $(W, Fe, Cr)_7C_3$, $(W, Fe, Cr)_6C$, etc. Herein, the equivalent circle diameter of a composite carbide is a diameter of a circle having the same area as that of the composite carbide particle in a photomicrograph, like the above Fe—Si—O-based particle. The cemented carbide containing no composite carbides having equivalent circle diameters of 5 μm or more in the binder phase has bending strength of 1700 MPa or more. Herein, "containing substantially no composite carbides" means that composite carbides having equivalent circle diameters of 5 μm or more are not observed on the SEM photograph (magnification of 1000). Composite carbides having equivalent circle diameters of less than 5 μm may exist in an amount of less than about 5% by area when measured by EPMA, in the cemented carbide of the present invention.

(3) Bainite Phases and/or Martensite Phases

The binder phase in the cemented carbide of the present invention preferably has a structure containing 50% or more in total by area of bainite phases and/or martensite phases. The use of the term "bainite phases and/or martensite phases" is due to the fact that bainite phases and martensite phases have substantially the same function, and that it is difficult to distinguish them on the photomicrograph. With such structure, the cemented carbide of the present invention has high compressive yield strength and mechanical strength.

Because the total amount of bainite phases and/or martensite phases in the binder phase is 50% or more by area, the cemented carbide of the present invention has compressive yield strength of 1200 MPa or more. The total amount of bainite phases and/or martensite phases is preferably 70% or more by area, more preferably 80% or more by area, and most preferably substantially 100% by area. Other phases than bainite phases and martensite phases are pearlite phases, austenite phases, etc.

(4) Diffusion of Fe into WC Particles

The EPMA analysis has revealed that in the sintered cemented carbide, WC particles contain 0.3-0.7% by mass of Fe.

(C) Properties

The cemented carbide of the present invention having the above composition and structure has compressive yield strength of 1200 MPa or more and bending strength of 1700 MPa or more. Accordingly, when a rolling composite cemented carbide roll having an outer layer made of the cemented carbide of the present invention is used for the cold rolling of metal (steel) strips, dents due to the compressive yield of the roll surface can be reduced, enabling the continuous high-quality rolling of metal strips with a long life span of the composite roll. Also, because the cemented carbide of the present invention contains 0.05-2.0% by area of Fe—Si—O-based particles, it has excellent sticking resistance. Accordingly, the rolling composite cemented carbide roll of the present invention is also suitable as a roll for hot-rolling metal strips.

Figure 3:
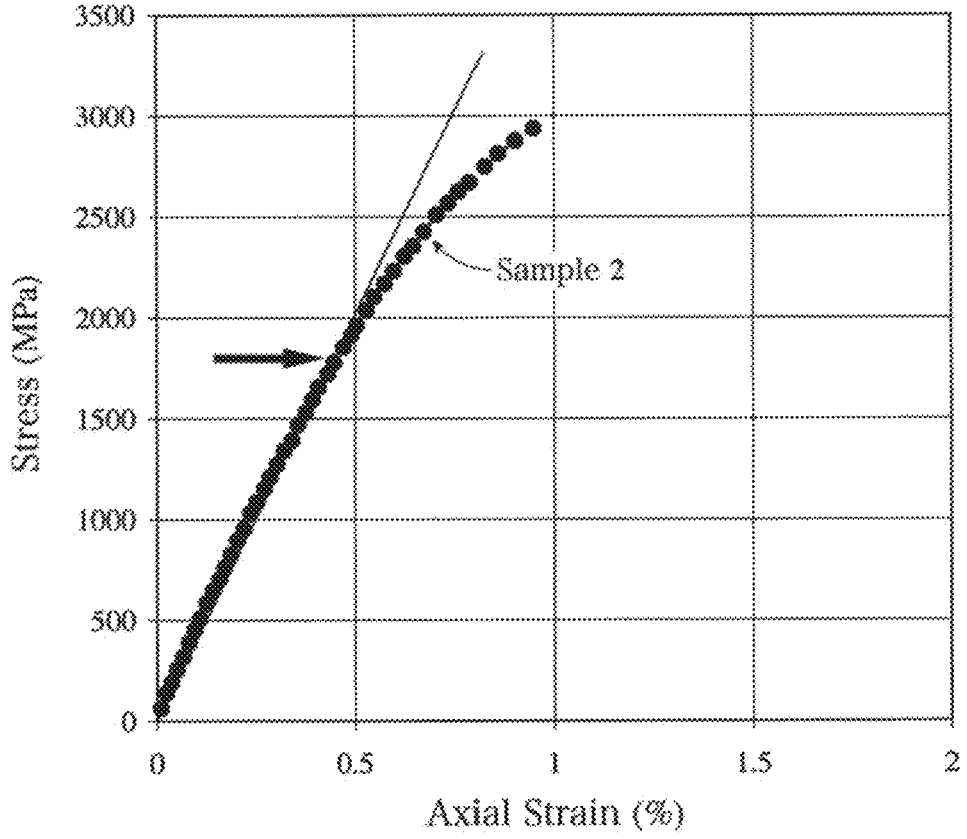
FIG. 3 is a graph showing a stress-strain curve of Sample 2, which were obtained by a uniaxial compression test.
Figure 4:
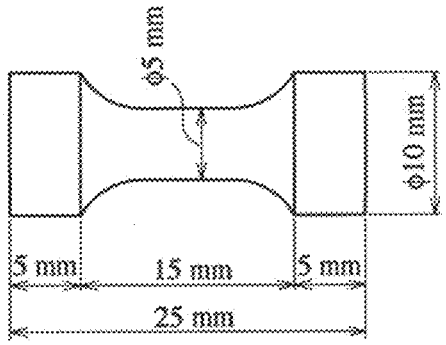
FIG. 4 is a schematic view showing a test piece used in the uniaxial compression test.

The compressive yield strength is yield stress determined by a uniaxial compression test of a test piece shown in FIG. 4 under an axial load. Namely, in a stress-strain curve determined by the uniaxial compression test as shown in FIG. 3, stress at a point at which the stress and the strain deviate from a straight linear relation is defined as the compressive yield strength.

The cemented carbide of the present invention has compressive yield strength of more preferably 1500 MPa or more, and most preferably 1600 MPa or more, and bending strength of more preferably 2000 MPa or more, and most preferably 2300 MPa or more.

The cemented carbide of the present invention further has Young's modulus of 385 GPa or more and Rockwell hardness of 80 HRA or more. The Young's modulus is preferably 400 GPa or more, and more preferably 450 GPa or more. Also, the Rockwell hardness is preferably 82 HRA or more.

[2] Production Method of Cemented Carbide (A) Powder for Molding 55-90 parts by mass of WC powder, and 10-45 parts by mass of metal powder comprising 0.5-10% by mass of Ni, 0.3-2.2% by mass of C, 0.5-5% by mass of Cr, 0.2-2.5% by mass of Si, and 300-5000 ppm of O, the balance being Fe and inevitable impurities, are wet-mixed in a ball mill to prepare the powder for molding. Because O is adsorbed onto the metal powder or exists as surface oxides, its amount can be adjusted to 300-5000 ppm by reduction after mixing or molding. Because W is diffused from the WC powder to the binder phase during sintering, the metal powder may not contain W. Also, to prevent the generation of composite carbides, the amount of C in the metal powder should be 0.3-2.2% by mass, and is preferably 0.5-1.7% by mass, and more preferably 0.5-1.5% by mass.

The metal powder for forming the binder phase may be a mixture of constituent element powders, or alloy powder containing all constituent elements. Carbon may be added in the form of powder such as graphite, carbon black, etc., or may be added to powder of each metal or alloy. Cr may be added in the form of its alloy with Si (for example, $CrSi_2$).

(1) Si: 0.2-2.5% by Mass

Si is necessary to form Fe—Si—O-based particles, and to strengthen the binder phase as described above. Less than 0.2% by mass of Si does not form Fe—Si—O-based particles sufficiently, and has an insufficient effect of strengthening the binder phase. On the other hand, when Si is more than 2.5% by mass, a large amount of Fe—Si—O-based particles are formed, and graphite is likely crystallized, providing the cemented carbide with low strength. The lower limit of the Si content is preferably 0.3% by mass, and more preferably 0.5% by mass. Also, the upper limit of the Si content is preferably 2.4% by mass, and more preferably 2.3% by mass.

(2) O: 300-5000 ppm

O is necessary for forming Fe—Si—O-based particles with Si and Fe in the metal powder. When O is less than 300 ppm, 0.05% or more by area of Fe—Si—O-based particles cannot be formed, providing an insufficient effect of improving the sticking resistance. On the other hand, when O exceeds 5000 ppm, more than 2% by area of Fe—Si—O-based particles are formed, resulting in low strength. The lower limit of the O content is preferably 400 ppm, and more preferably 500 ppm, and the upper limit of the O content is preferably 4000 ppm, and more preferably 3000 ppm.

(B) Molding

After drying, the powder for molding is formed into a green body having a desired shape by a method such as die-pressing, cold-isostatic pressing (CIP), etc. Incidentally, the powder for molding may be charged into a HIP can for a HIP treatment without molding.

(C) HIP Treatment

The green body is charged into a steel HIP can, which is evacuated and sealed. This HIP can is placed in a HIP furnace, and subjected to a HIP treatment at 1240±40° C. and 100-140 MPa. When the powder for molding is subjected to a HIP treatment without molding, the powder for molding is charged into a steel HIP can, evacuated, and sealed to conduct the HIP treatment.

(D) Cooling

The HIPed body is cooled at an average rate of 60° C./hour or more between 900° C. and 600° C. When cooled at an average rate of less than 60° C./hour, the resultant binder phase in the cemented carbide contains a large percentage of pearlite phases, failing to have 50% or more in total by area of bainite phases and/or martensite phases, thereby providing the cemented carbide with low compressive yield strength. Cooling at an average rate of 60° C./hour or more may be conducted in the cooling process in a HIP furnace, or after cooling in a HIP furnace, the HIPed body may be heated again to 900° C. or higher in another HIP furnace, and then cooled.

[3] Uses

The cemented carbide of the present invention is preferably used for an outer layer metallurgically bonded to a tough steel sleeve or shaft of a composite roll. Because the outer layer of this rolling composite cemented carbide roll has high compressive yield strength, bending strength, Young's modulus, hardness and sticking resistance, it is particularly suitable for the cold rolling and hot rolling of metal (steel) strips. The rolling composite cemented carbide roll of the present invention is preferably used as a work roll in (a) a 6-roll stand comprising a pair of upper and lower work rolls for rolling a metal strip, a pair of upper and lower intermediate rolls for supporting the work rolls, and a pair of upper and lower backup rolls for supporting the intermediate rolls, or (b) a 4-roll stand comprising a pair of upper and lower work rolls for rolling a metal strip, and a pair of upper and lower backup rolls for supporting the work rolls. At least one stand described above is preferably arranged in a tandem mill comprising pluralities of stands.

In addition, the cemented carbide of the present invention can also be widely used for wear-resistant tools, corrosion-resistant, wear-resistant parts, molding dies, etc., which have been made of conventional cemented carbides.

The present invention will be explained in further detail by Examples below, without intention of restricting the present invention thereto.

Example 1

80 parts by mass of WC powder [purity: 99.9%, and D10: 4.3 μm, median diameter D50: 6.4 μm, and D90: 9.0 μm, which were measured by a laser diffraction particle size distribution meter (SALD-2200 available from Shimadzu Corporation)], and 20 parts by mass of a binder phase-forming powder having the composition shown in Table 1 were mixed to prepare mixture powders (Samples 1-3). Each binder phase-forming powder had a median diameter D50 of 1-10 μm, and contained trace amounts of inevitable impurities.

Each of the mixture powders was wet-mixed for 20 hours in a ball mill, dried, and then subjected to a reduction reaction in a reducing atmosphere of a hydrogen-helium mixture gas at 750° C., such that the amount of oxygen in the metal powder was adjusted to 450 ppm in Sample 1, 2330 ppm in Sample 2, and 150 ppm in Sample 3.

TABLE 1

| Sample | Composition of Binder Phase-Forming Powder (% by mass, ppm for O) | | | | | | | | | |
|---|---|---|---|---|---|---|---|---|---|---|
| No. | Si | Mn | Ni | Cr | Mo | V | C | Co | O | Fe(1) |
| 1 | 0.80 | — | 5.02 | 1.21 | — | — | 1.29 | — | 450 | Bal. |
| 2 | 0.81 | — | 5.01 | 1.20 | — | — | 1.23 | — | 2330 | Bal. |
| 3* | 0.80 | — | 5.02 | 1.21 | — | — | 1.29 | — | 150 | Bal. |

Note: * Comparative Example.

(1) The balance includes in evitable impurities.

Each of the powders was charged into a HIP can, which was evacuated and sealed, subjected to a HIP treatment at 1230° C. and 140 MPa for 2 hours, cooled at an average cooling rate of 100° C./hour between 900° C. and 600° C., and then annealed at 350° C., to produce a cemented carbide (outer diameter: 60 mm, and length: 40 mm) of Sample 1 (within the present invention), Sample 2 (within the present invention), and Sample 3 (Comparative Example). Each cemented carbide was evaluated by the following methods.

(1) Compressive Yield Strength

Each compression test piece shown in FIG. 3 was cut out of each cemented carbide, and a strain gauge was attached to a center portion of a surface thereof to obtain a stress-strain curve under an axial load. In the stress-strain curve, stress at a point at which the stress and the strain deviated from a straight linear relation was regarded as the compressive yield strength. The results are shown in Table 2.

(2) Bending Strength

A test piece of 4 mm×3 mm×40 mm cut out of each cemented carbide was measured with respect to bending strength under 4-point bending conditions with an interfulcrum distance of 30 mm. The results are shown in Table 2.

(3) Young's modulus

A test piece of 10 mm in width, 60 mm in length and 1.5 mm in thickness, which was cut out of each cemented carbide, was measured by a free-resonance intrinsic vibration method (JIS Z2280). The results are shown in Table 2.

(4) Hardness

The Rockwell hardness (A scale) of each cemented carbide was measured. The results are shown in Table 2.

(5) Area Ratio of Sticking

Figure 5:
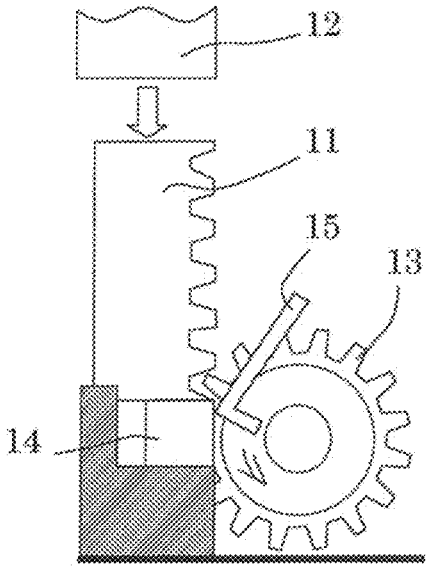
FIG. 5 is a schematic view showing a test machine for evaluating thermal shock by friction.

To evaluate the sticking resistance, a sticking test was conducted on the cemented carbide test pieces of Samples 1 and 2, using a test machine for evaluating thermal shock by friction shown in FIG. 5. In the test machine for evaluating thermal shock, a weight 12 is dropped onto a rack 11 to rotate a pinion 13, so that a member to be bitten is brought into strong contact with a test piece 14. The sticking was evaluated by an area ratio of sticking.

TABLE 2

| Sample No. | Compressive Yield Strength (MPa) | Bending Strength (MPa) | Young's Modulus (GPa) | Hardness (HRA) | Area Ratio of sticking (% by area) |
|---|---|---|---|---|---|
| 1 | 1500 | 2297 | 460 | 84.2 | 25 |
| 2 | 1500 | 2297 | 450 | 83.8 | 23 |
| 3* | 1700 | 2488 | 475 | 84.4 | 33 |

Note:
*Comparative Example.

(6) Observation of Structure

Figure 2A:
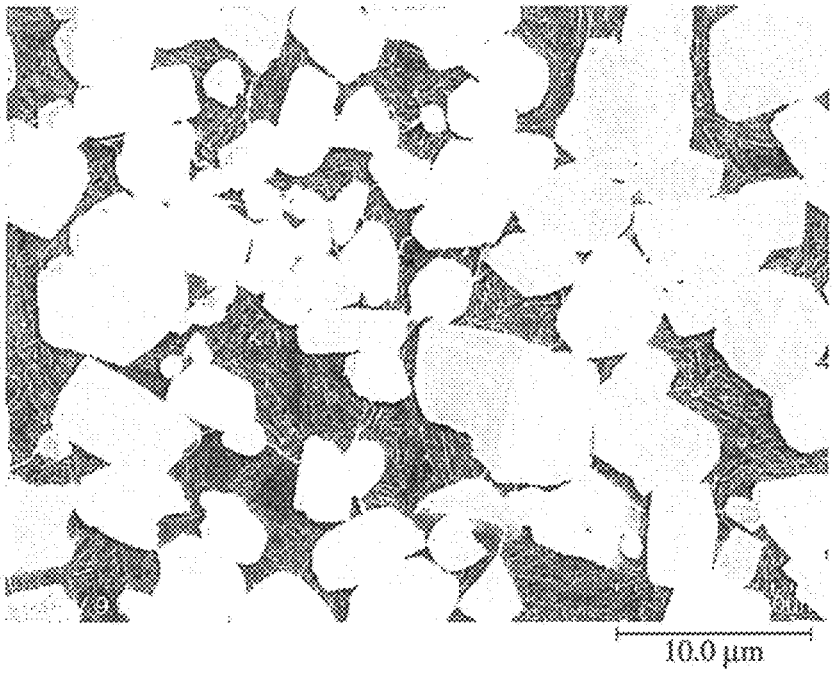
FIG. 2(*a*) is a photograph of a secondary electron image of SEM showing a cross section structure of the cemented carbide of Sample 2 (Comparative Example).
Figure 2B:
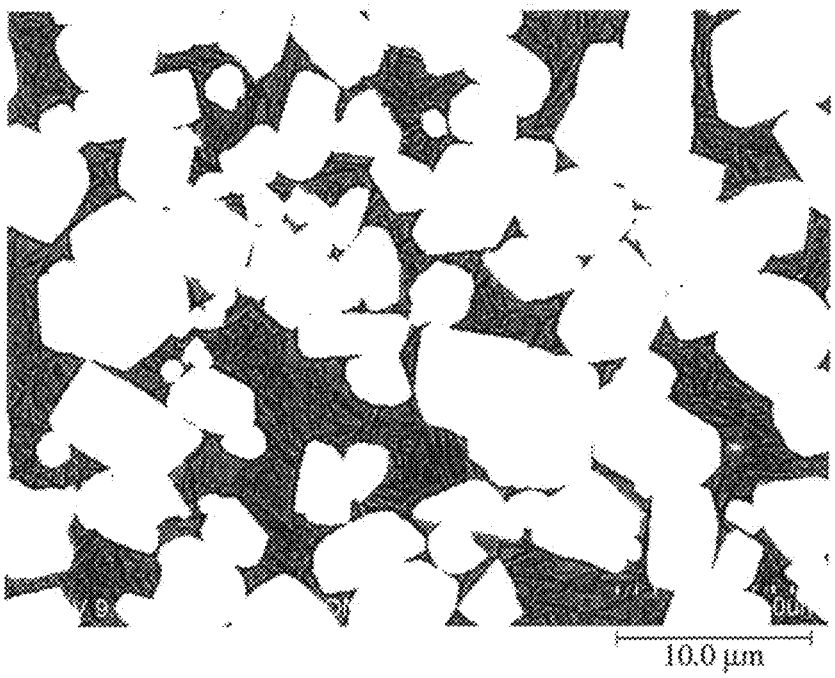

Each sample was mirror-polished, and observed by SEM. FIGS. 1 and 2 are SEM photographs of the cemented carbides of Samples 1 and 3. FIGS. 1(*a*) and 2(*a*) are photographs showing secondary electron images, and FIGS. 1(*b*) and 2(*b*) are photographs showing backscattered electron images. In the photographs showing backscattered electron images, white granular portions are WC particles, gray portions are binder phases, and black spots are Fe—Si—O-based particles. The Fe—Si—O-based particles are clearly discernable particularly in the backscattered electron image of FIG. 1(*b*). The presence or absence of composite carbides, and the total area ratios of bainite phases and martensite phases in the binder phase were determined from these SEM photographs. The results are shown in Table 3. The Fe—Si—O-based particles were also observed as black particles in an optical microscopic observation of a polished surface, confirming one-to-one correspondence. Accordingly, the area ratio of Fe—Si—O-based particles was calculated from the areas of black particles in optical microscopic observation (magnification of 1000).

Further, the compositions of Fe—Si—O-based particles and the binder phase in Sample 1 were measured by SEM-EDX (acceleration voltage: 5 kV, and beam diameter: 1 μm). C in the binder phase was point-analyzed by a field emission electron probe microanalyzer (FE-EPMA) with a beam diameter of 1 μm. The results are shown in Table 4.

TABLE 3

| Sample No. | Fe-Si-O-Based Particles (1) | Composite Carbides (2) | Bainite Phases and/or Martensite Phases (3) |
|---|---|---|---|
| 1 | 0.32% by area | No | 50% or more by area |
| 2 | 0.85% by area | No | 50% or more by area |
| 3* | 0% by area | No | 50% or more by area |

Note: * Comparative Example.

(1) The total area ratio (%) of Fe—Si—O-based particles having equivalent circle diameters of 0.1-3 μm.

(2) The presence of absence of composite carbides having diameters of 5 μm or more in the binder phase.

(3) The area ratio (%) of bainite phases and martensite phases in the binder phase.

TABLE 4

| | Composition of Sample 1 | | | | | | |
|---|---|---|---|---|---|---|---|
| | W | Si | Ni | Fe | Cr | C | O |
| Binder Phase | 2.8 | 0.6 | 4.5 | Bal. | 0.9 | 0.8 | — |
| Fe—Si—O-based Particles | 5.4 | 17.8 | 2.2 | Bal. | 0.7 | — | 20.2 |

Note: The amount of each element is shown by "% by mass."

Samples 1 and 2 were better than Sample 3, exhibiting lower area ratios of sticking than that of Sample 3.

What is claimed is:

1. A cemented carbide comprising 55-90 parts by mass of WC particles and 10-45 parts by mass of a binder phase containing Fe in an amount of 50% by mass or more;

said binder phase having a composition comprising
2.5-10% by mass of Ni,
0.2-2% by mass of C,
0.5-5% by mass of Cr,
0.2-2.0% by mass of Si, and
0.1-5% by mass of W,
the balance being Fe and inevitable impurities, and
containing 0.05-2.0% by area of Fe—Si—O-containing particles.

2. The cemented carbide according to claim 1, wherein said cemented carbide does not contain Fe—Si—O-containing particles having equivalent circle diameters of 3 μm or more, where the equivalent circle diameter of an Fe—Si—O-containing particle is a diameter of a circle having the same area as that of the Fe—Si—O-containing particle in a polished cross section of the cemented carbide.

3. The cemented carbide according to claim 2, wherein among said Fe—Si—O-containing particles, the ratio of particles having equivalent circle diameters of 0.1-3 μm is 0.05-2.0% by area in total.

4. The cemented carbide according to claim 1, wherein said cemented carbide contains no composite carbides having equivalent circle diameters of 5 μm or more, where the equivalent circle diameter of a composite carbide is a diameter of a circle having the same area as that of the composite carbide in the cemented carbide.

5. The cemented carbide according to claim 1, wherein said WC particles have a median diameter D50 of 0.5-10 μm.

6. The cemented carbide according to claim 1, wherein said binder phase further contains 0-5% by mass of Co, and 0-1% by mass of Mn.

7. The cemented carbide according to claim 1, wherein the total amount of bainite phases and/or martensite phases in said binder phase is 50% or more by area.

8. The cemented carbide according to claim 1, wherein said cemented carbide has compressive yield strength of 1200 MPa or more.

9. A composite cemented carbide roll for rolling, which comprises an outer layer made of the cemented carbide recited in claim 1, which is metallurgically bonded to an outer peripheral surface of a steel sleeve or shaft.

10. The cemented carbide according to claim 1, wherein said Fe—Si—O-containing particles comprise 10-30% by mass of Si, 10-40% by mass of 0, 0.3-5% by mass of Ni, 0-3% by mass of C, 0.3-3% by mass of Cr, and 1-10% by mass of W, the balance being Fe and inevitable impurities.

11. The cemented carbide according to claim 1, which comprises 55-85 parts by mass of WC particles and 15-45 parts by mass of the binder phase.

12. The cemented carbide according to claim 1, wherein the Ni content of said binder phase is 3-10% by mass.

13. The cemented carbide according to claim 1, wherein the Ni content of said binder phase is 4-10% by mass.

* * * * *